US008866046B2

(12) United States Patent
Matsumoto et al.

(10) Patent No.: US 8,866,046 B2
(45) Date of Patent: Oct. 21, 2014

(54) ENERGIZATION HEATING METHOD AND ENERGIZATION HEATING DEVICE

(75) Inventors: Shin'ichiroh Matsumoto, Toyota (JP); Kazuomi Yamanishi, Tajimi (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 190 days.

(21) Appl. No.: 13/501,112

(22) PCT Filed: Oct. 16, 2009

(86) PCT No.: PCT/JP2009/005412

§ 371 (c)(1),
(2), (4) Date: Apr. 10, 2012

(87) PCT Pub. No.: WO2011/045845

PCT Pub. Date: Apr. 21, 2011

(65) Prior Publication Data

US 2012/0193336 A1 Aug. 2, 2012

(51) Int. Cl.

| | |
|---|---|
| ***H05B 3/00*** | (2006.01) |
| ***C21D 1/40*** | (2006.01) |
| ***B21D 37/16*** | (2006.01) |
| ***C21D 9/00*** | (2006.01) |
| *C21D 1/673* | (2006.01) |

(52) U.S. Cl.

CPC ..... *C21D 1/40* (2013.01); *H05B 3/0004* (2013.01); *C21D 1/673* (2013.01); *B21D 37/16* (2013.01); *C21D 9/0068* (2013.01)

USPC ..... 219/200

(58) Field of Classification Search

USPC ..... 219/200

See application file for complete search history.

(56) References Cited

U.S. PATENT DOCUMENTS

| | | | | |
|---|---|---|---|---|
| 2007/0215588 | A1 | 9/2007 | Machrowicz | |
| 2010/0285328 | A1 | 11/2010 | Nonomura et al. | |
| 2012/0118440 | A1* | 5/2012 | Nakanishi et al. | 148/567 |

FOREIGN PATENT DOCUMENTS

DE 102 12 820 C1 4/2003

(Continued)

OTHER PUBLICATIONS

International Search Report Issued Jan. 19, 2010 in PCT/JP09/05412 Filed Oct. 16, 2009.

*Primary Examiner* — Shawntina Fuqua

(74) *Attorney, Agent, or Firm* — Oblon, Spivak, McClelland, Maier & Neustadt, L.L.P.

(57) ABSTRACT

Provided is a technique in which blanks in different shapes are uniformly healed using energization healing. An energization heating process (S1) is a method for heating a blank (1) by connecting a pair of electrodes (10, 10) to two different end parts of the blank (1) so as to energize the electrode pair (10, 10), wherein the blank (1) is provided with void parts (cutouts (4, 4), a hole (5)) provided in a direction approximately perpendicular to the equipotential line generated between the electrode pair (10, 10), and current passages (current paths (20, 20)) are arranged in the direction approximately perpendicular to the equipotential line generated between the electrode pair (10, 10) within the regions spaced by the void parts (4, 4, 5) in the blank (1). The cutouts (4, 4) are formed with the end parts of the blank (1) as open parts, the hole (5) is provided to the inside of the blank (1), and the reverse side of the side on which the current paths (20, 20) arranged in the cutouts (4, 4) are connected to the blank (1) is connected to the electrodes (10, 10).

7 Claims, 5 Drawing Sheets

(56) References Cited

FOREIGN PATENT DOCUMENTS

| | | |
|---|---|---|
| JP | 2002 248525 | 9/2002 |
| JP | 2005 131665 | 5/2005 |
| JP | 2008 87001 | 4/2008 |
| JP | 2009-274122 | 11/2009 |

* cited by examiner

ENERGIZATION HEATING METHOD AND ENERGIZATION HEATING DEVICE

TECHNICAL FIELD

The present invention relates to a method for heating a blank by energization heating, and particularly to a technique of electrically heating the blank for die quenching.

BACKGROUND ART

Die quenching is well known, in which steel plate blanks are heated by energization heating and press-formed in a mold (for example, see JP 2008-87001 A). The blank to be press-formed is heated in advance so that the moldability is improved.

The blanks are heated above the predetermined temperature (where the austenaitc transformations occur), and the blanks are kept in contact with the cold mold, thereby quenching is performed with the press-forming.

In the respects of environment and safe, the products made of the steel plates for automotive applications have been high strength recently. However, the high strength plates need the guarantee in accuracy of connecting the multiple products. Moreover, in order to improve productivity and reduce the number of parts, the integration of multiple parts is required.

There are various techniques of answering such requirements, for instance, in order to integrate the multiple parts into one member, the high-strength blanks with desired shape (H-shape. T-shape or holed shape) are prepared, whereby the blanks with different shapes are heated and press-formed.

In order to heat the blanks with different shapes uniformly, heating the blanks for a long time in the heating furnace is not preferable because the facility and energy for the furnace would cost too much.

When the technique of JP 2008-87001 A is used to heat the blanks having the different shapes, in which the energization is operated from one end to the opposite end of the blank, there may be a variation in electric current flow at spaces between the electrodes where the section area changes largely. Thus, there may be a variation in current density in the blank, and it is difficult to obtain the even heating. To avoid such defectives, the multiple parts tire prepared for configuring the blank with the different shape, and the heating process and press-forming process is performed to each part, after that the multiple parts are combined into the blank.

Alternatively, JP 2002-248525 A discloses the technique of heating the blank with the different shape by energization heating, in which the multiple pairs of electrodes are connected to the opposite ends of the blank and used to energize the blank. Unfortunately, the technique of JP 2002-248525 A may fail to equalize the current density in the blank, because the current density largely changes at the portion where the section area perpendicular to the energization direction largely changes (e.g., if the blank has H-shape, the connection portions between the two parallel portions and the orthogonal portion).

As mentioned above, it is difficult to uniformly heat the blank that has the different shape in response to the recent requirement.

CITATION LIST

Patent Literature

PTL 1: JP 2008-87001 A
PTL 2: JP 2002-248525 A

SUMMARY OF INVENTION

Technical Problem

The present invention aims to provide a technique of evenly heating a blank having a different shape using an energization heating.

Technical Solution

The first embodiment of the present invention is a method for heating a blank by an energization using a pair of electrodes connected with two different ends of the blank, wherein the blank has a space formed in a direction perpendicular to equipotential lines generated between the electrode pair, and a current path is arranged at both ends of a periphery separated by the space in the direction perpendicular to the equipotential lines.

The second embodiment of the present invention is a method for heating a blank by an energization using a pair of electrodes connected with two different ends of the blank, wherein the blank has a space formed in a direction perpendicular to equipotential lines generated between the electrode pair, and the space comprises: a first space formed at an end of the blank, opening the end of the blank; and a second space formed inside the blank, current paths are arranged at both ends of peripheries separated by the first and second spaces in the direction perpendicular to the equipotential lines, and the current path connected to the first space is connected to the electrode.

In the advantageous embodiment of the present invention, the electrode pair is configured as bar electrodes disposed in parallel, and connected to the two opposite ends of the blank, and the current path is arranged perpendicular to the arrangement direction of the electrode pair.

Preferably, the current path is made of a material having lower electric resistance.

More advantageously, the end periphery separated by the space in the blank, to which the current path is connected, is formed as an inclined line or a curved line, and the current path is connected to the inclined or curved line of the blank via an extension material made of the same material as the blank and disposed perpendicular to the arrangement direction of the electrode pair.

In the embodiment of the present invention, the blank comprises: a first portion extended straightly from one end to the opposite end of the blank; a second portion extended with curved shape from the one end to the opposite end of the blank and combined to the first portion at the opposite end; and a third portion connecting the middle portions of the first and second portions, and one of the electrode pair to which the one end of the blank is connected is longer than the other one to which the opposite end of the blank is connected.

The third embodiment of the present invention is an apparatus for heating a blank by an energization using a pair of electrodes connected with two different ends of the blank, wherein the blank has a space formed in a direction perpendicular to equipotential lines generated between the electrode pair, a current path is provided with at both ends of a periphery separated by the space in the direction perpendicular to the equipotential lines, the electrode pair is configured as bar electrodes disposed in parallel, and connected to the two opposite ends of the blank, and the current path is arranged perpendicular to the arrangement direction of the electrode pair.

Advantageous Effects of Invention

According to the embodiment of the present invention, when operating the energization healing to the blank having the different shape formed with a portion where the section area changes such as spaces, the spaces are bypassed and the current density in the blank is equalized. Therefore, the blank having the different shape is heated evenly by using the energization heating.

EXPLANATION OF NUMERALS

1: blank, 10: electrode, 20: current path, 50: blank, 60: electrode pair, 70: group of current paths, 80: group of extension materials Description of Embodiments Referring to attached drawings, embodiments of a method for energization heating according to the present invention are described below.

In the energization heating method, blanks are energized and heated. After the energization heating, the blanks are delivered to die quenching process or hot press process.

During the die quenching process, the blanks, which have been heated above a predetermined temperature by the energization heating method of the present invention, are press-formed with the blanks rapidly quenched in a press mold.

The die quenching process is required to improve the quality of press-forming and of quenching. In other respects, the objective is to heat the blanks evenly such that the blanks to be delivered to the die quenching process are heated above the predetermined temperature where the qualities of press-forming and quenching are guaranteed.

Moreover, to reduce the number of process and the number of members, it is required to prepare the blanks ready to be used as a product through subsequent processes such as die quenching and trimming, that is, the blanks having different shapes from rectangular, and to directly transfer from the energization heating process to die quenching process.

The present invention provides a new energization heating technique solving the above problems, and the embodiments of the invention are described below.

[First Embodiment]

Referring to FIGS. 1 to 5, an energization heating process S1 as a first embodiment of the energization healing method is described below, in which a blank 1 is energized and heated.

The blank 1, as a heating object in the energization heating process S1, is made of a material with conductivity and quenchability such as steel. The blank 1 is a plate having a "different shape."

The "different shape" means the shape different from rectangle that is used for the object to be heated in the conventional energization heating process. For instance, the different shape is a H-shape, a T-shape, or a holed shape that is obtained by trimming a rectangular part or integrating some parts, and the blank with such shape is used as a product after the die quenching process and trimming process.

Furthermore, a blank having rectangular shape, into which multiple parts with different resistances are integrated by laser welding or the like, is accounted as the different shape in the invention, because when energizing such blank, the current density varies in response to the electrical resistances of the multiple parts and it is difficult to provide the even heating distribution.

Figure 1:
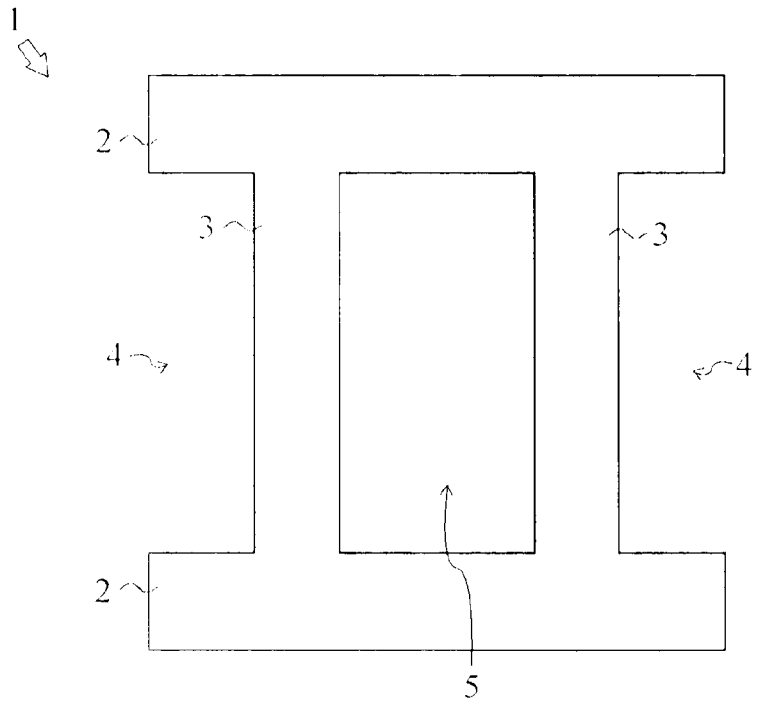
FIG. 1 illustrates a blank.

For the convenience of the explanation, the upper-lower direction and left-right direction of the blank 1 are defined as the upper-lower direction and left-right direction in FIG. 1, respectively.

As shown in FIG. 1, the blank 1 has two lateral portions 2 and two vertical portions 3, and the ends of the vertical portions 3 are connected to the sides of the lateral portions 2, thereby integrated into one part.

The lateral portions 2 are disposed in parallel and extended from one end to the opposite end of the blank 1 (in the left-right direction). The vertical portions 3 are disposed in parallel and extended perpendicular to the left-right direction (in upper-lower direction).

The blank 1 has two cutouts 4 at the both ends and a single hole 5 at the center. The cutouts 4 are disposed at the both opposite ends of the blank 1 and partially open the ends of the blank 1 rectangularly. The hole 5 is a rectangular opening disposed at the center of the blank 1, surrounded by the portions of blank 1. The blank 1 is formed in the holed shape, in which the cutouts 4 and the hole 5 are removed from the rectangular shape.

The way of preparing the blank 1 is to trim the cutouts 4 and the hole 5 from the rectangular plate or to combine the lateral portions 2 and the vertical portions 3 (prepare a tailored blank).

In the blank 1, prepared in the above-described manner, the connecting portions between the lateral portions 2 and the vertical portions 3 are formed as a portion where the section area changes largely along the upper-lower direction perpendicular to the line from the left end to the right end, and as a portion where the section area changes largely along the left-right direction perpendicular to the line from the upper end to the lower end.

In other words, the cutouts 4 and the hole 5 make the blank 1 defined as the object having the large variation in section area along not only the left-right direction but also the upper-lower direction.

Figure 2:
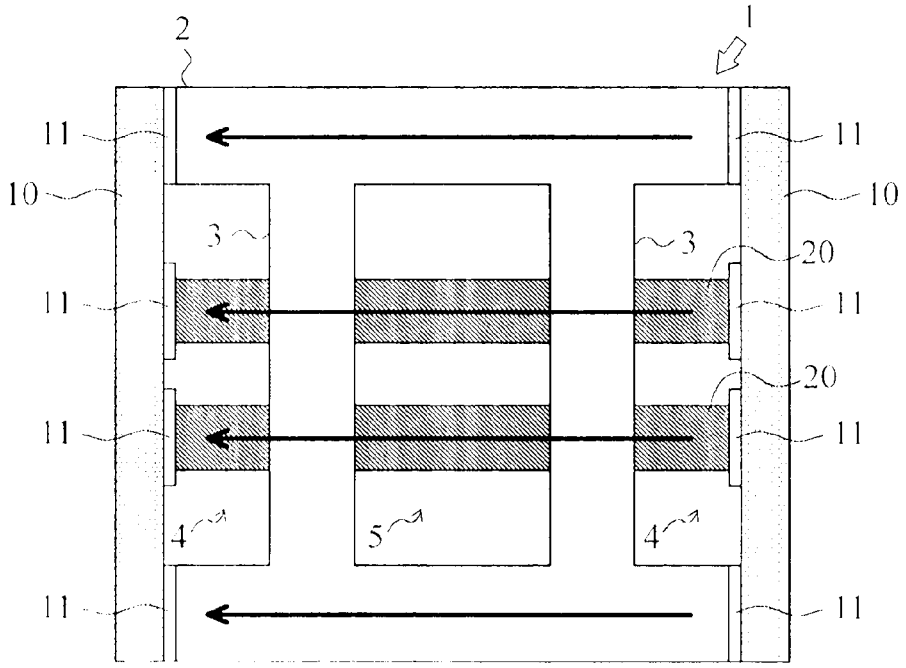
FIG. 2 illustrates an energization heating process.

As illustrated in FIG. 2, in the energization heating process S1, a pair of electrodes 10 and multiple current paths 20 are used to heat the blank 1.

The electrode pair 10 and the current paths 20 are installed in an energization heating apparatus, to which the blank 1 is transferred and the energization heating process S1 is operated.

The electrode pair 10 energizes the blank 1, and the one is used for a positive electrode and the other is used for a negative electrode. The electrode 10 is configured as a bar electrode having a longitudinal direction. The electrodes 10 are connected to a power source feeding the desired electric current, which applies current to the blank 1 through the electrodes 10. In the blank 1, the current occurs from the positive electrode 10 to the negative electrode 10.

The electrode 10 is extended along the upper-lower direction and has the substantially same length as the blank 1. The electrode pair 10 is arranged to contact the both ends of the lateral portions 2 of the blank 1, that is, both ends in one direction of the two perpendicular directions. The energization direction of the electrodes 10 is the left-right direction of the blank 1.

As shown in FIG. 2, the electrode pair 10 includes multiple connectors 11 provided with clamping structure for clamping the blank 1 from the thickness direction to secure the electrical connection with the blank 1 and the current paths 20. The connector 11 includes clips to clamp the blank actuated by an air cylinder or a hydraulic cylinder, and the actuators switch the connecting/disconnecting between the electrode 10 and the blank 1.

The clamping structure of the connectors 11 contained in the electrode pair 10 enables to maintain the contact between the blank 1 and the electrodes 10. The clamping-type connectors reduce the influence of the deformation such as curving or roll back of the blank 1 that occurs during the energization heating and provide the uniform heating, compared with contact-type connectors.

Figure 3:
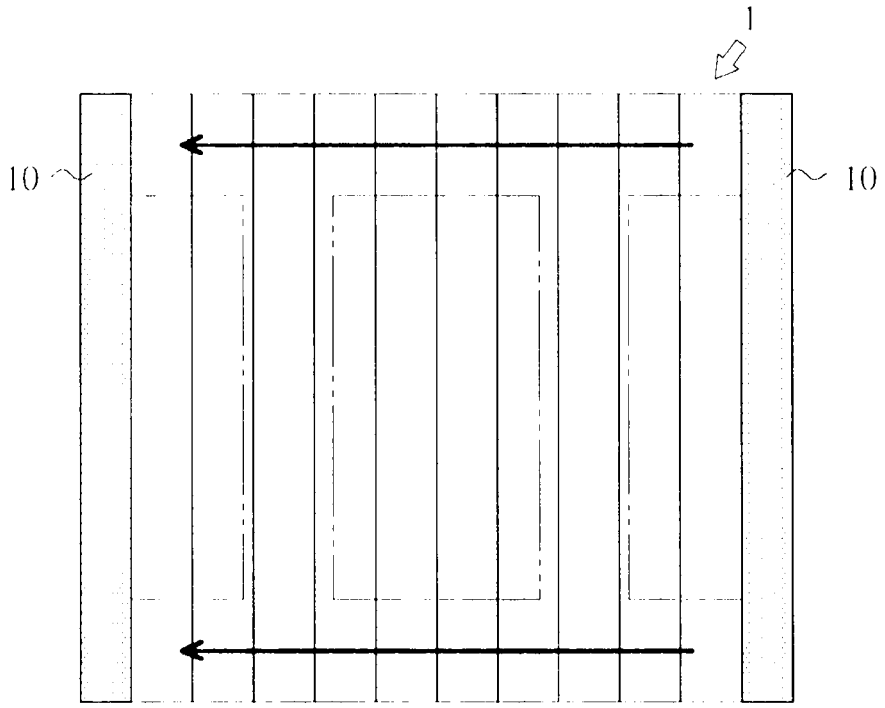
FIG. 3 illustrates an electrode pair and equipotential lines generated between the electrode pair.

If the blank 1 is configured in rectangular, the equipotential lines generated from the positive electrode 10 to the negative electrode 10 are shown in FIG. 3. As shown in FIG. 3, the bar electrodes 10 generate the equipotential lines parallel to the arrangement direction of the electrodes 10.

Actually, the blank 1 has the cutouts 4 and hole 5 extended perpendicular to the equipotential lines between the electrodes 10. In the embodiment, the cutouts 4 are spaces between the electrodes 10 and the blank 1, and the hole 5 is space disposed inside of the blank 1, whereby these spaces act as non-energized areas and bring the variation in current density.

Figure 4:
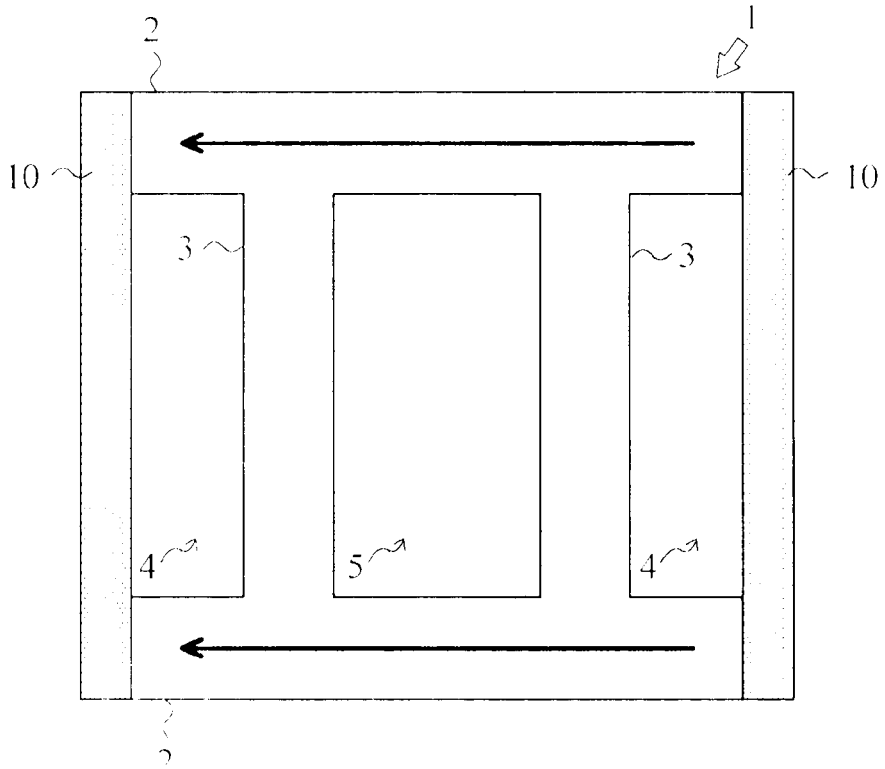
FIG. 4 shows a conventional energization heating process.

FIG. 4 shows the conventional energization heating process, in which the blank 1 is heated by the electrode pair 10.

The energization to the blank 1 is operated in one direction (from right to left in drawing) by using the electrodes 10. There occurs current from the right side to the left side of the lateral portions 2 of the blank 1.

In the connecting area A where the lateral portions 2 and the vertical portion 3 are connected, the vertical length is sum of the lateral portions 2 and the vertical portion 3. Therefore, in the connecting area A, the section area perpendicular to the energization direction is locally large and there is a large variation in the current density, so that the electric current hardly passes through the vertical portions 3.

Figure 5:
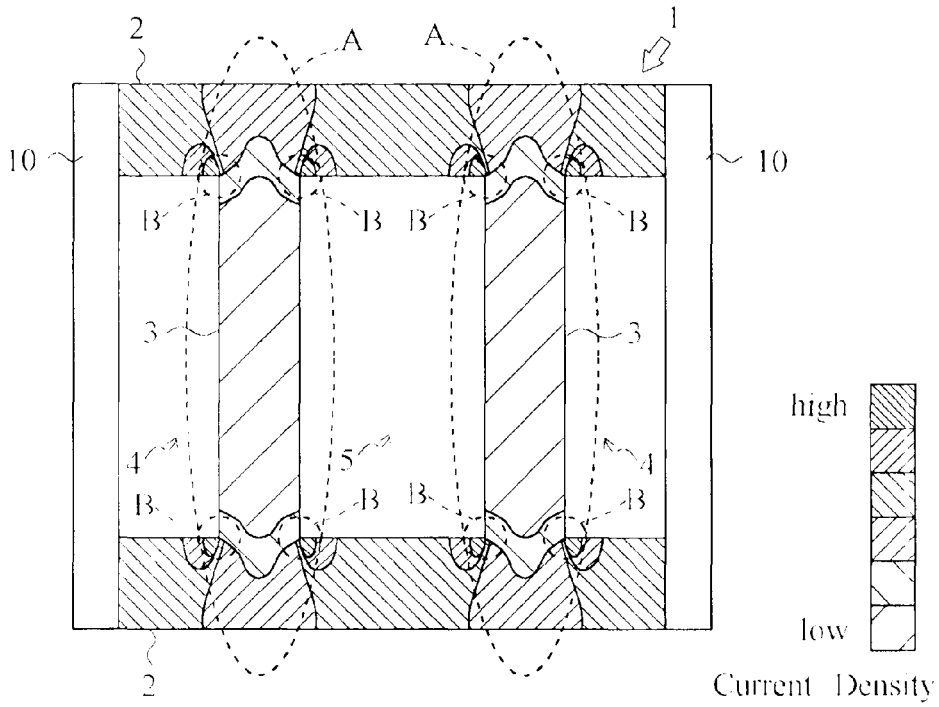
FIG. 5 shows a distribution of current density by the conventional energization heating process.

In detail. FIG. 5 depicts the variations, shown in below (1) and (2).

(1) The connecting points B between the lateral portion 2 and the vertical portion 3 make right angles, and the passing direction of the electric current extremely changes at the connecting point B. The electric current gathers to the connecting points B, so that the current density is high.

(2) The lateral portions 2 are directly connected to the electrodes 10, and the current density in the lateral portions 2 is high. The resistance at the current branch from the lateral portion 2 to the vertical portion 3 is large, and therefore the current density in the vertical portions 3 is low.

As described above, if the conventional energization heating process using the electrode pair 10 is performed to the blank 1 that has the different shape, it may fail to heat evenly due to the variation in current density.

In the present embodiment, as shown in FIG. 2, the electrode pair 10 energizes the blank in one direction (from right to left in drawing), and the electric current is bypassed through the current paths 20 to the vertical portions 3.

The current paths 20 are plate electrodes made of the material having lower electrical resistances than the blank 1 (e.g. when the blank 1 is made of steel, the current path 20 is made of cupper or carbon), and are connected with the blank 1. The current paths 20 are extended along the left-right direction and arranged parallel to the lateral portions 2.

The current paths 20 are divided into three sections to connect the right electrode 10 with the right vertical portion 3, the right vertical portion 3 with the left vertical portion 3 and the left vertical portion 3 with the left electrode 10 (alternatively, the three sections are integrated as one member). The electrode paths bypass the non-energized areas between the electrodes 10 defined by the cutouts 4 and the hole 5 of the blank 1 to which the electrode pair 10 is connected.

Via the current paths 20, the electric current passes from the positive electrode 10 where the current density is high to the negative electrode 10 through the vertical portions 3 where the current density is low.

In the embodiment, the cutouts 4 are the openings formed at the ends of the blank 1, so that the ends of the current paths 20 disposed in the cutouts 4 are connected to the electrodes 10. The hole 5 is the opening surrounded by the blank 1, so that the ends of the current paths 20 disposed in the hole 5 are connected to the blank 1.

Figure 6:
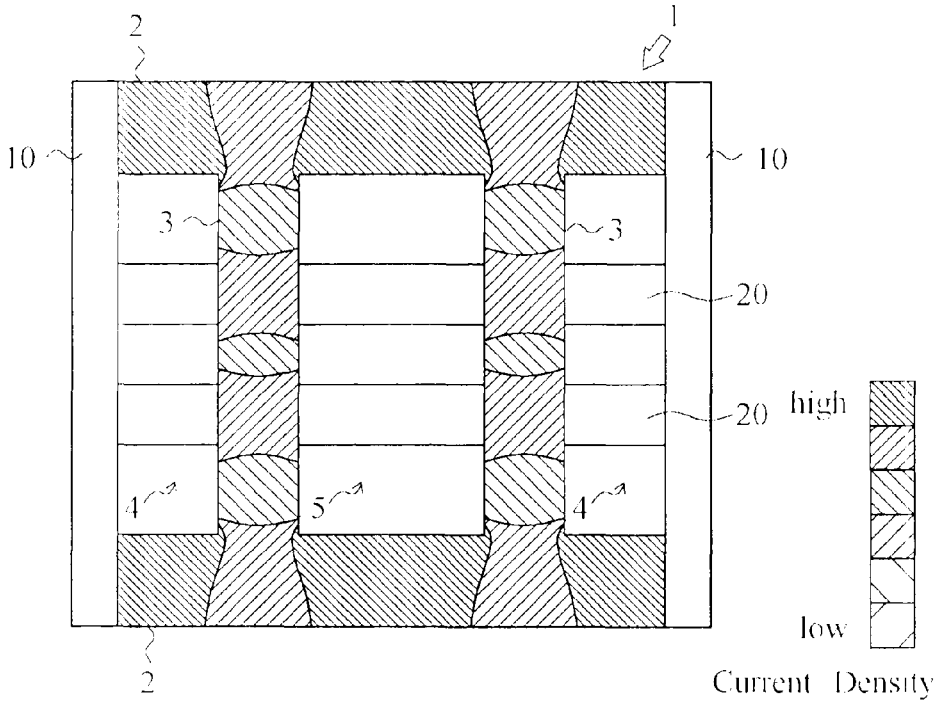
FIG. 6 shows a distribution of current density by the present energization heating process.

As shown in FIG. 6, when energizing between the electrodes 10, the electric passage from the electrode 10 to the lateral portions 2 is bypassed via the current paths 20, thereby passing the current to the vertical portions 3. Hence, the current density in the vertical portions 3 is increased, and the current density in the blank 1 is equalized.

In other words, arranging the current paths 20 parallel to the lateral portions 2 makes the change of the section area along the direction perpendicular to the energization direction between the electrodes 10 small, thereby improving the evenness of the current density in the blank 1.

As described above, due to the current paths 20, the energization heating process S1 provides the improvement in evenness of the current density in the blank 1 and obtains even heating. Moreover, the energization heating process S1 improves the quality and productivity in the pressing or quenching after the heating process.

The current paths 20 bypass the electric current from the high current-density area toward the low current-density area. i.e. the positive electrode 10 to the vertical portions 3 which are separated from the electrodes 10 by the non-energized areas (the cutouts 4 and the hole 5) and extended along the orthogonal direction with respect to the energization direction.

Due to this structure, overheat at the connecting points B as the intersections of the current passage is prevented, and the sufficient differential of electric potential occurs between the left and right ends of the vertical portions 3. The current paths 20 reduce the variation in the current density and contribute to the equation of the current density.

The current paths 20 connect between the peripherals of the blank 1 defined by the cutouts 4 and the hole 5, which are extended perpendicular to the equipotential lines generated between the electrodes 10.

Thus, the vertical portions 3, which are separated from the electrodes 10 by the spaces and thus located as the low current-density areas, are energized by bypassing through the current paths 20, thereby equalizing the current density in the blank.

The current paths 20 are arranged orthogonal to the bar electrodes 10, namely the paths are extended in the left-right direction and the electrodes are extended in the upper-lower direction. That is, the current paths 20 are extended perpendicular to the equipotential lines generated between the electrodes 10.

The current density in the current paths 20 is even, and the bypass though the current paths are efficiently done.

Moreover, the electrodes 10 are configured as the bar electrodes extended in one direction, and therefore, if the electrodes 10 are set parallel to the opposite sides of the blank 1, the large section areas are obtained with regard to the energization direction. Thus, the uniform equipotential lines are generated and the heating efficiency is improved.

The current path 20 is made of the material that has lower resistance than the blank 1, so that the current density in the current path 20 is higher than that in the lateral portions 2. As a result, the electric current applied from the electrode 10 is smoothly led to the vertical portions 3 via the current paths 20.

On the contrary, if the current paths 20 have higher resistance than the blank 1, the current paths 20 are more heated than the blank 1 by the energization, thereby degrading the heating efficiency.

It should be noted that the object to be heated by the energization heating process S1 is not limited to the blank 1. For example, the blank may be configured not only in H-shape. T-shape or rectangular with some holes inside, but also in rectangular shape, in which multiple different materials are combined and shows the current distribution due to the difference in electric resistances during the energization.

If the blank to be heated occurs the variation in current density therein when a pair of electrodes energizes from one end to the opposite end, the energization heating process S1 provides the uniform heating, in which the electric current is bypassed from the high current-density area to the low current-density area.

Moreover, the blank may be a steel pipe having varying diameter, and the energization heating process S1 is likewise applicable.

The energization direction of the energization heating process S1 is not limited to the above embodiment, and changeable in accordance with the shape of the blank 1 or heating conditions.

for example, when the upper-lower direction of the blank 1 is set as the energization direction, the current paths 20 are arranged to connect the lateral portions 2 at the outer side of the vertical portions 3. In this case, the current density in the blank 1 is also equalized.

The electrodes 10 used in the energization heating process S1 are the bar electrodes generating the even equipotential lines, and may be substituted by an electrode pair enabled to generate the even equipotential lines between the electrode pair.

Figure 7:
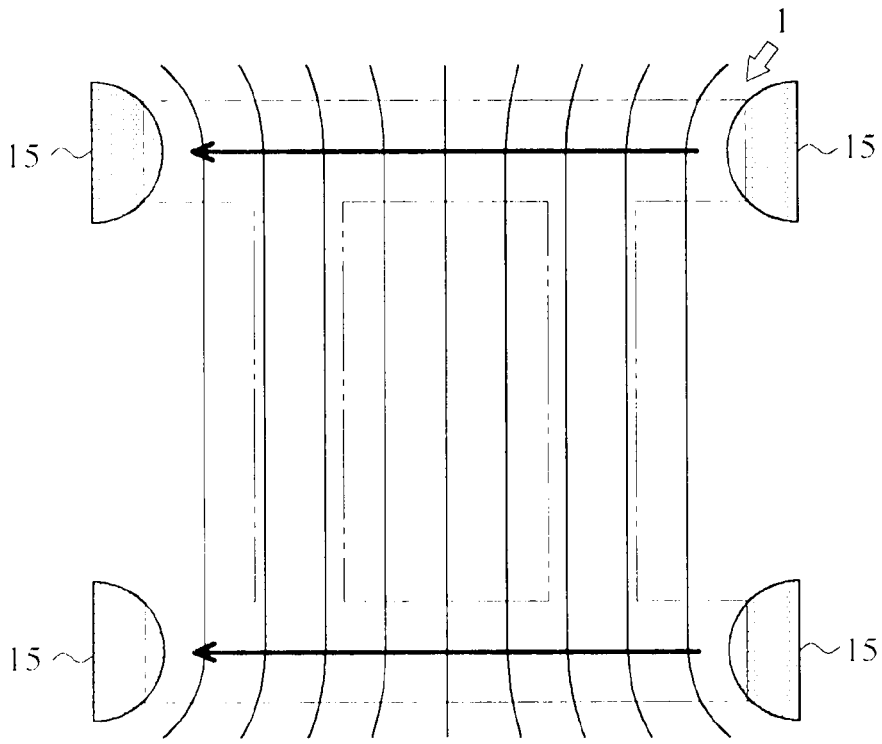
FIG. 7 depicts an alternative pair of electrodes and equipotential lines generated by the electrode pair.

For example, two pairs of hemispherical electrodes 15 may work. The hemisphere electrode pairs 15 generate the equipotential lines shown in FIG. 7, so that the number of the electrodes or the arrangement of the electrodes is adjusted to generate the desired equipotential lines, that is, parallel lines along the ends of the blank 1.

If the blank 1 has curved ends and the connecting portions to the electrodes 10 are not straight, preparing additional electrode members corresponding to the shape of the connecting portions to the blank 1 provides the straight connection with the electrodes 10.

That is to say, the end peripheries of the blank are not limited to the straight shapes as the blank 1, and the energization heating process S1 is applicable to the blanks with any end shapes.

As for the blank 1, each current path 20 is preferably located to divide the vertical portion 3 into three in the upper-lower direction. The configuration such as arrangement or number of the current paths 20 is selectable in response to the shape of the blank 1 to achieve the even current density in the blank 1.

In the other embodiment, the current paths may be configured as conductive wires, which connect the high-potential area to the low-potential area so that the electric current is bypassed from the high current-density area to the low current-density area.

Alternatively, the blank is heated without connected with the current paths, detecting the heating state by capturing the heat image or simulation, and the best mode for the current paths is selected and arranged according to the detection.

[Second Embodiment]

Figure 8:
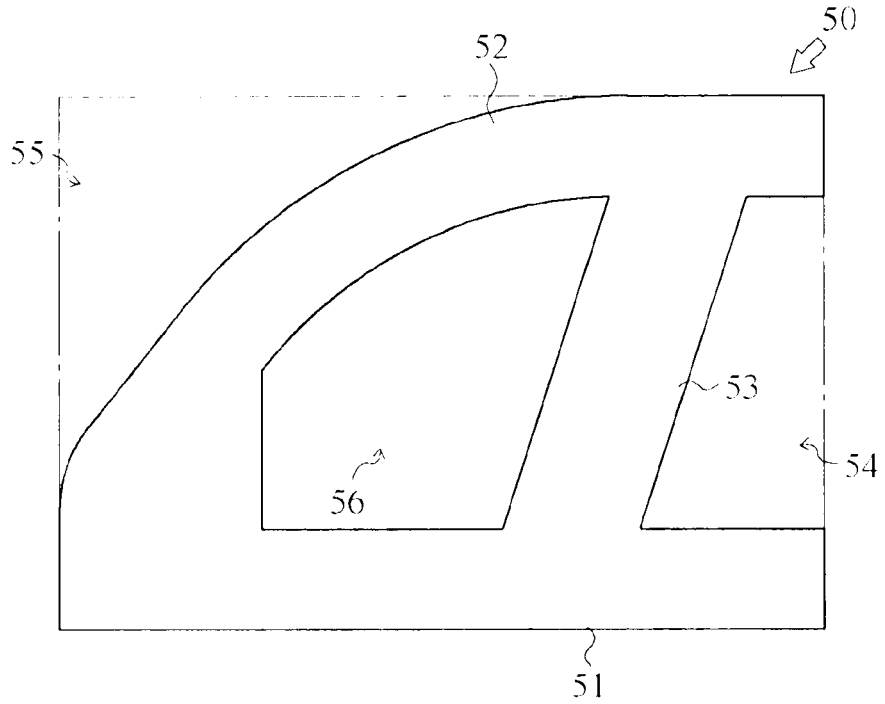
FIG. 8 illustrates an alternative embodiment of the blank.
Figure 9:
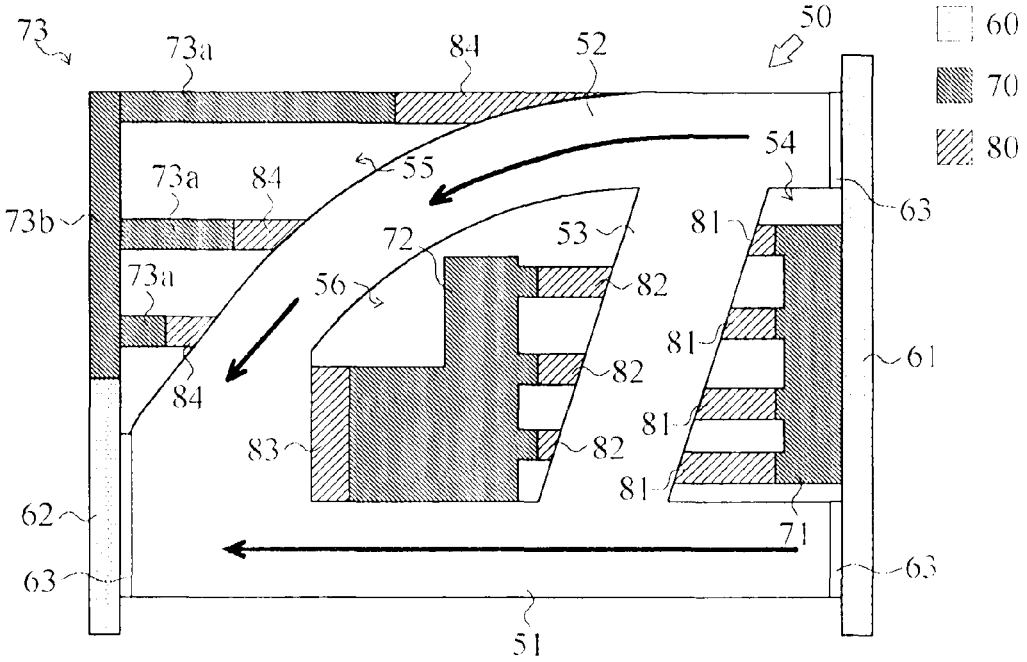
FIG. 9 illustrates an alternative energization heating process.
Figure 10:
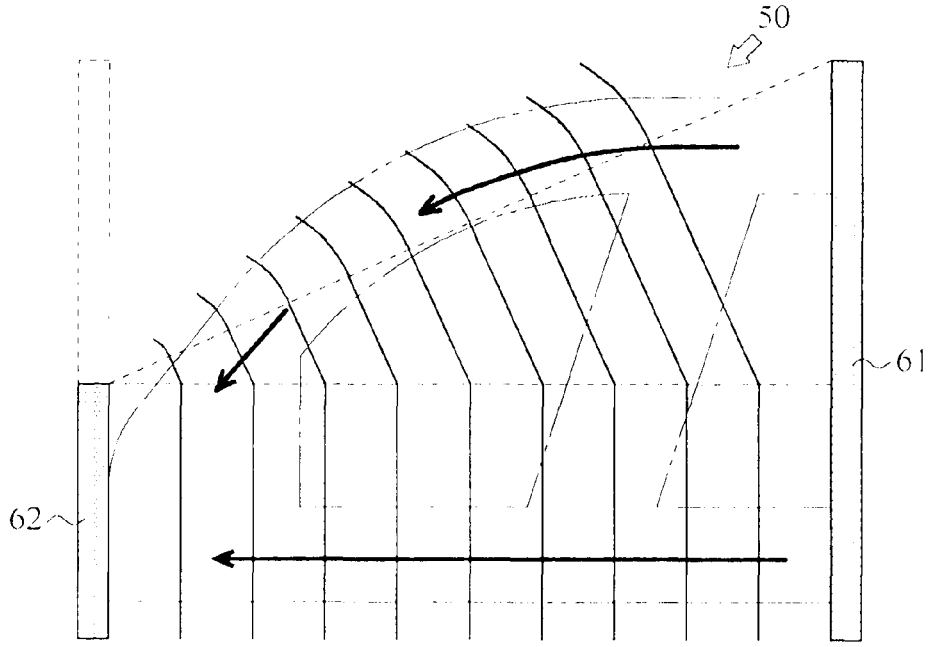
FIG. 10 shows an electrode pair and equipotential lines generated by the electrode pair.

Referring to FIGS. 8 to 10, an energization heating process S2 as a second embodiment of the energization healing method is described below, in which a blank 50 is energized and heated.

For the convenience of the explanation, the upper-lower direction and left-right direction of the blank 50 are defined as the upper-lower direction and left-right direction in FIG. 8, respectively.

The blank 50, as a heating object in the energization heating process S2, is made of a material with conductivity and quenchability such as steel. The blank 50 is a plate member having a "different shape."

As shown in FIG. 8, the blank 50 has a first portion 51, a second portion 52 and a third portion 53, and the sides of the first portion 51 and the second portion 52 are connected to the ends of the third portion 53, thereby integrated into one member.

These portions 51, 52 and 53 may be made of the same materials or different materials from each other and selectable in accordance with the characteristics of the materials such as rigidity of the blank 50.

The first portion 51 is extended from one end (right end in drawings) of the two opposite ends of the blank 50 to the other end (left end in drawings). The first portion 51 is straight portion extended along the left-right direction.

The second portion 52 is extended from the one end (right end in drawings) of the blank 50 to the opposite end (left end in drawings). The second portion 52 is curved downwardly from the one end (right end in drawings) to the other end (left end in drawings). At the one end (right end in drawings), the second portion 52 is separated from the first portion 51, and at the other end (left end in drawings), the second portion 52 is combined to the first portion 51.

The third portion 53 is extended substantially perpendicular to the direction from the one end to the other end and connected with the middle portions of the first portion 51 and the second portion 52. The third portion 53 is inclined against the upper-lower direction.

The blank 50 includes a cutout 54 provided at the right end, a cutout 55 provided at the left end and a hole 56 provided at the center. The chain-dotted line in FIG. 9 represents the outer line if the blank 50 is rectangular.

The cutout 54 is an opening disposed at the right end of the blank 50, and has a trapezoidal shape. In the blank 50, the end periphery (left side) of the cutout 54 is formed as an inclined straight line.

The cutout 55 is an opening disposed at the left upper portion of the blank 50. In the blank 50, the end periphery (right side) of the cutout 55 is formed as a curved line. The cutout 55 makes the vertical length in the left side of the blank 50 shorter than that in the right side.

The hole 56 is a rough square opening disposed at the center of the blank 50. In the blank 50, the right end line defined by the hole 56 is an inclined straight line and the upper side defined by the hole is a curved line.

The way of preparing the blank 50 is to trim the cutouts 54, 55, and the hole 56 from the rectangular plate or to combine the first portion 51, the second portion 52 and the third portion 53 (prepare a tailored blank).

As illustrated in FIG. 9, in the energization heating process S2, a pair of electrodes 60, a group of current paths 70 and a group of extension materials 80 are used to heat the blank 50.

The pair of electrodes 60 and the group of current paths 70 are installed in an energization heating apparatus, to which the blank 50 is transferred and the energization heating process S2 is operated.

The electrode pair 60 energizes the blank 50. The electrode pair 60 consists of a first electrode 61 connected to the one end of the blank 50 and a second electrode 62 connected to the other end of the blank 50, and one of the electrodes 61 and 62 is used as a positive electrode and the other is used as a negative electrode.

The electrodes 61 and 62 are configured as bar electrodes having longitudinal directions. The electrodes 61 and 62 are connected to a power source feeding the desired electric current, which applies current to the blank 50 through the electrodes 61 and 62. In the blank 50, the current occurs from the positive electrode 61 to the negative electrode 62.

The electrode 61 is extended along the upper-lower direction and has the substantially same length as the right side of the blank 50. The electrode 62 is extended along the upper-lower direction and has the substantially same length as the left side of the blank 50. The length of the electrode 61 is longer than that of the electrode 62.

As shown in FIG. 9, the electrodes 61 and 62 include multiple connectors 63 provided with clamping structure for clamping the blank 50 from the thickness direction to secure the electrical connection with the blank 50. The connector 63 includes clips to clamp the blank actuated by an air cylinder or a hydraulic cylinder, and the actuators switch the connecting/disconnecting between the electrodes 61, 62 and the blank 50.

The clamp structure of the connector 63 contained in the electrodes 61 and 62 enables to maintain the contact between the blank 50 and the electrodes 61 and 62. The clamping-type connectors reduce the influence of the deformation such as curving or roll back of the blank 50 that occurs during the energization heating and provide the uniform heating, compared with contact-type connectors.

If the blank 50 is configured as rectangular plate, the equipotential lines generated from the positive electrode 61 to the earth electrode 62 are shown in FIG. 10. As shown in FIG. 10, the bar electrodes 61 and 62 generate the equipotential lines parallel to the electrodes 61 and 62 where the bar electrodes face each other and generate the equipotential lines inclined from the upper end of the electrode 61 to the upper end of the electrode 62 above the electrode 62, that is, where the electrodes 61 and 62 do not face.

Actually, the blank 50 has the cutouts 54, 55 and the hole 56 arranged perpendicular to the equipotential lines between the electrodes 61 and 62. In the embodiment, the cutouts 54 and 55 are spaces between the electrodes 61, 62 and the blank 50 and the hole 56 is space disposed inside of the blank 50, whereby these spaces act as non-energized areas and bring the variation in current density.

In the embodiment, as shown in FIG. 9, the electrode pair 60 energizes the blank in one direction (from right to left in drawing), and the electric current passes through the group of current paths 70 and the group of extension electrodes 80 to the third portion 53 bypassing the cutout 54 and the hole 56 and to the electrode 62 bypassing the cutout 55 from the curved end of the second portion 62.

All of the group of current paths 70 are plate electrodes made of the material having lower electrical resistance than the blank 50 (e.g. when the blank 50 is made of steel, the each current path 70 is made of cupper or carbon), and are connected with the blank 50. The group of current paths 70 is extended along the left-right direction.

As shown in FIG. 9, the group of current paths 70 includes a first path 71 connecting the electrode 61 to the right side of the third portion 53, a second path 72 connecting the left side of the third portion 53 to the right side of the second portion 52, and a third path 73 connecting the left side of the second portion 52 to the electrode 62.

The first current path 71 is disposed at the space formed by the cutout 54 and arranged perpendicular to the equipotential lines generated between the pair of electrodes 60. The second current path 72 is disposed at the space formed by the hole 56 and arranged perpendicular to the equipotential lines generated between the pair of electrodes 60. The current path 73 is disposed at the space formed by the cutout 55 and arranged perpendicular to the equipotential lines generated between the pair of electrodes 60.

In the embodiment, "perpendicular to the equipotential lines" means to cross the equipotential line at right angle and at enough angle (e.g. above 45 degrees), and the "enough angle" is defined as the angle where flow of the electric current generating the equipotential lines is influenced by the current path crossing thereto.

The third current path 73 contains first portions 73*a* extended in the left-right direction and a second portion 73*b* connecting the first portions 73*a* to the electrode 62 and extended in the upper-lower direction. The first portions 73*a* and the second portion 73*b* are perpendicular to the equipotential lines generated between the pair of electrodes 60. In other words, the second portion 73*b* of the third path 73 extends the electrode 62 in the upper direction, whereby the electrode 62 and the second portion 73*b* make the vertical electrode with the same length as the electrode 61.

As described above, the group of current paths 70 bypasses the non-energized area formed by the cutouts 54, 55 and the hole 56 along the direction perpendicular to the equipotential lines between the electrode pair 60.

All of the extension materials 80 are made of the same materials as the blank 50 (steel or the like), and connected with the blank 50. The group of extension materials 80 is extended along the left-right direction. The group of extension materials 80 connects the blank 50 and the group of current paths 70 at the inclined sides and curved side of the blank.

As depicted in FIG. 9, the group of extension materials 80 is formed such that the blank 50 is straightly connected to the group of current paths 70. That is, the ends of the group of extension materials 80 are formed as straight lines at the connections to the group of current paths 70.

The clamping structures are used to electrically connect the group of extension materials 80 to the group of current paths 70, and as described above, the straight connections between the group of extension materials 80 and the group of current paths 70 make the clamping resistances reduced and improve the heating efficiency by means of the electric current passing through the group of current paths 70.

The clamping structures may be the same as the connectors 11 installed in the electrodes 10 as in the first embodiment.

As shown in FIG. 9, the group of extension materials 80 includes first materials 81 connecting the first current path 71 to the right side of the third portion 53, second materials 82 connecting the left side of the third portion 53 to the second current path 72, a third material 83 connecting the second current path 72 to the right side of the second portion 52, and fourth materials 84 connecting the left curved side of the second portion 52 to the third current path 73.

The way to connect the group of extension materials 80 with the blank 50 is to prepare the blank 50 including such materials or to fix the materials to the blank 50 after preparing the blank 50. Regardless of the way to connect, the extension materials 80 are not used in the product and removed in the trimming process or the like after the energization heating process S2.

The number or arrangement of the extension materials (81, 82, 83 and 84) of the group of extension materials 80 is not limited to the present embodiment.

In the energization heating process S2, the energization is operated with the group of current paths 70, and therefore the current density in the blank 50 is equalized and the uniform heating is provided. Moreover, the energization heating process S2 improves the quality and productivity in the pressing or quenching after the process.

It should be noted that the second embodiment brings the same effects as the first embodiment.

Furthermore, in the present embodiment using the group of extension materials 80 to connect the group of current paths 70 to the blank 50, the following effects are obtained.

The peripherals of the cutouts 54, 55 and the hole 56 formed as the spaces in the blank 50 contain the curved shape (the left side of the second portion 52) and the inclined shape to the energization direction by the electrode pair 60 (the both sides of the third portion 53). Therefore, if the group of current paths 70 is directly connected to the blank 50, there may be defects in the heating condition or the clamping condition. In the embodiment, the group of extension materials 80 is formed with the blank 50 and the group of current paths 70 is connected to the blank 50 via the group of extension materials 80, which improves the heating property, thereby providing the even heating.

In the present embodiment, the electrode pair 60 includes the electrode 61 and 62 having the different lengths from each other to correspond to the lengths of the ends of the blank 50. However, the electrode 62 may have the same length as the maximum upper-lower length of the blank 50 (i.e., the electrode 61). In this ease, the equipotential lines generate by the electrode pair 60 is parallel to the arrangement direction of the electrode pair 60.

Industrial Applicability

The present invention is applicable to a technique of heating by energizing a blank, and particularly to the technique of evenly heating the blank, which causes a distribution of current density while energizing by using a single pair of electrodes.

The invention claimed is:

1. A method for heating a blank by an energization using a pair of electrodes connected with two different ends of the blank, wherein the blank has a space formed in a direction perpendicular to equipotential lines generated between the electrode pair, and a current path is arranged at both ends of a periphery separated by the space in the direction perpendicular to the equipotential lines.

2. A method for heating a blank by an energization using a pair of electrodes connected with two different ends of the blank, wherein the blank has a space formed in a direction perpendicular to equipotential lines generated between the electrode pair, and the space comprises: a first space formed at an end of the blank, opening the end of the blank; and a second space formed inside the blank, current paths are arranged at both ends of peripheries separated by the first and second spaces in the direction perpendicular to the equipotential lines, and the current path connected to the first space is connected to the electrode.

3. The method according to claim 1 or 2, wherein the electrode pair is configured as bar electrodes disposed in parallel, and connected to the two opposite ends of the blank, and the current path is arranged perpendicular to the arrangement direction of the electrode pair.

4. The method according to one of claim 1 or 2, wherein the current path is made of a material having lower electric resistance.

5. The method according to one of claim 1 or 2, wherein the end periphery separated by the space in the blank, to which the current path is connected, is formed as an inclined line or a curved line, and the current path is connected to the inclined or curved line of the blank via an extension material made of the same material as the blank and disposed perpendicular to the arrangement direction of the electrode pair.

6. The method according to claim 5, wherein the blank comprises: a first portion extended straightly from one end to the opposite end of the blank; a second portion extended with curved shape from the one end to the opposite end of the blank and combined to the first portion at the opposite end; and a third portion connecting the middle portions of the first and second portions, and one of the electrode pair to which the one end of the blank is connected is longer than the other one to which the opposite end of the blank is connected.

7. An apparatus for heating a blank by an energization using a pair of electrodes connected with two different ends of the blank, wherein the blank has a space formed in a direction perpendicular to equipotential lines generated between the electrode pair, a current path is provided with at both ends of a periphery separated by the space in the direction perpendicular to the equipotential lines, the electrode pair is configured as bar electrodes disposed in parallel, and connected to the two opposite ends of the blank, and the current path is arranged perpendicular to the arrangement direction of the electrode pair.

* * * * *